US006370932B1

(12) United States Patent
Liu

(10) Patent No.: US 6,370,932 B1
(45) Date of Patent: Apr. 16, 2002

(54) FOLDING APPARATUS FOR FOLDING PLATES

(75) Inventor: Yao-Tser Liu, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/710,486

(22) Filed: Nov. 10, 2000

(30) Foreign Application Priority Data

Sep. 1, 2000 (TW) ..... 089215210 U

(51) Int. Cl.[7] ..... B21D 5/01

(52) U.S. Cl. ..... 72/383; 72/387; 72/389.1; 72/389.7; 72/347

(58) Field of Search ..... 72/389.1, 389.8, 72/381, 383, 387, 347

(56) References Cited

U.S. PATENT DOCUMENTS 950,280 A * 2/1910 Everson ..... 72/389.1
3,927,548 A * 12/1975 Lannin ..... 72/321
4,141,235 A * 2/1979 Ishihara ..... 72/213
4,373,371 A * 2/1983 Liu ..... 72/379
5,007,224 A * 4/1991 Haack ..... 72/322
5,253,502 A * 10/1993 Poletti ..... 72/213
5,501,094 A * 3/1996 Mizuta et al. ..... 72/382
5,953,951 A * 9/1999 Fujimoto et al. ..... 72/379
6,185,975 B1 * 2/2001 Nicoletti ..... 72/306

* cited by examiner

*Primary Examiner*—David Jones
(74) *Attorney, Agent, or Firm*—Wei Te Chung

(57) ABSTRACT

A folding apparatus (10) includes a pair of dies (20) defining a recess (20M) therebetween, a cushion pad (30) vertically movable in the recess, a pair of support blocks (40), a pair of pivoting blocks (50) rotatable about the dies, and a vertically movable punch (60). The thickness of each pivoting block is substantially equal to the distance between the cushion pad and each die. Each pivoting block defines a groove (52) in an inner surface, for shifting the center of gravity outwardly. Each support block includes a horizontal portion (42) secured under the cushionpad, an inclined portion (46), and a shoulder (44) between the horizontal portion and the inclined portion.

12 Claims, 6 Drawing Sheets

FOLDING APPARATUS FOR FOLDING PLATES

BACKGROUND OF THE INVENTION

1. Field of the Related Invention

The present invention relates to a folding apparatus, and particularly to a folding apparatus for bending plates into special configurations.

2. Related Art

Referring to FIG. 9, a conventional folding apparatus 1 comprises a pair of dies 2 defining a recess 21 therebetween, a cushion pad 3 received in the recess 21, and a punch 4. The cushion pad 3 and the punch 4 are both vertically movable within the recess 21. The folding apparatus bends outer portions of a metal plate W at right angles relative to a central portion of the plate W, thereby forming a plate having a generally U-shaped cross-section.

However, the side walls of the dies 2 often unduly scrape the plate W, particularly when the plate W is moved a long distance relative to the dies 2. Furthermore, if side walls of the finished plate are high, distorted concave portions are frequently formed at bottom portions of the side walls adjacent a bottom wall of the finished plate. In addition, the plate W can only be bent at right angles, due to the limited configurations of the dies 2.

It is strongly desired to provide a folding apparatuswhich overcomes the above problems encountered in the prior art.

SUMMARY OF THE INVENTION

Accordingly, an object of the present invention is to provide a folding apparatus for manufacturing a bent plate with high side walls.

Another object of the present invention is to provide a folding apparatus for manufacturing a bent plate with angled side walls.

A further object of the present invention is to provide a folding apparatus for manufacturing a bent plate whereby scraping of the plate is minimized.

To achieve the above-mentioned objects, a folding apparatus in accordance with the present invention comprises a pair of dies defining a recess therebetween, a cushion pad vertically movable within the recess, a pair of support blocks secured under opposite sides of the cushion pad, a pair of pivoting blocks rotatable about the dies and slidable into the recess, and a vertically movable punch. The thickness of each pivoting block is substantially equal to the distance between the cushion pad and each die. Each pivoting block defines a groove in an inner surface thereof, for shifting the center of gravity thereof toward an outer portion thereof. Each support block comprises a horizontal portion, an inclined portion, and a shoulder between the horizontal portion and the inclined portion. The horizontal portion is secured under the cushion pad.

Other objects, advantages and novel features of the present invention will be drawn from the following detailed description of preferred embodiments of the present invention with reference to the attached drawings, in which:

DESCRIPTION OF THE PREFERRED EMBODIMENTS

Figure 1:
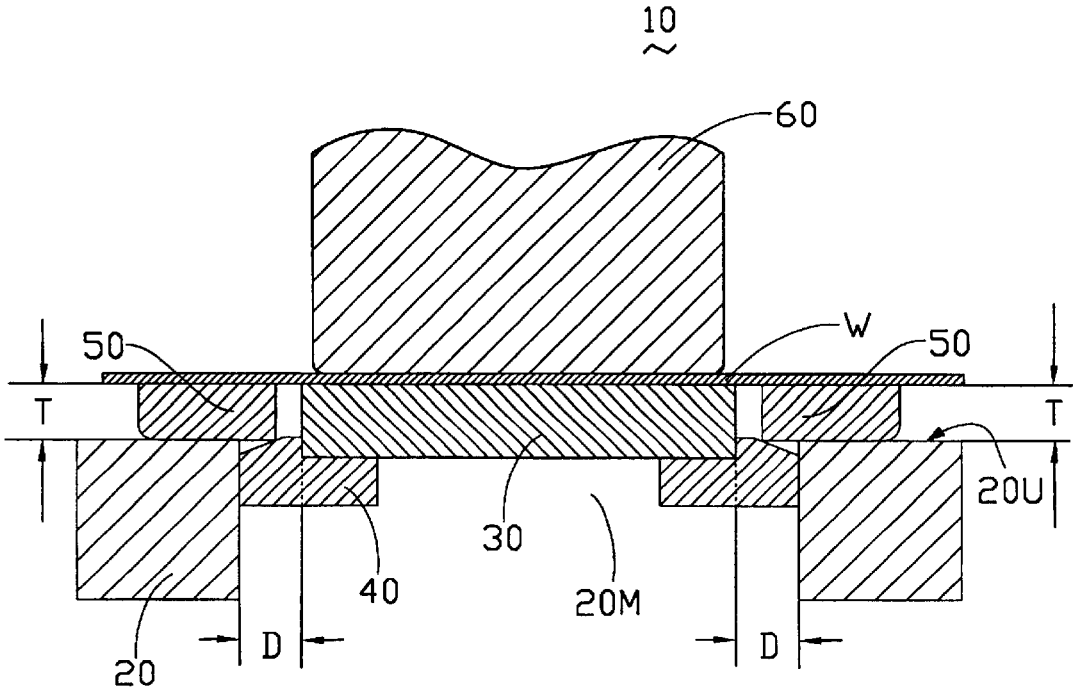
FIG. 1 is a partial cross-sectional view of a folding apparatus in accordance with a preferred embodiment of the present invention, also showing a plate ready for folding.

Referring to FIG. 1, a folding apparatus 10 in accordance with a preferred embodiment of the present invention comprises a pair of dies 20, a cushion pad 30, a pair of support blocks 40, a pair of pivoting blocks 50, and a vertically movable punch 60.

The dies 20 are set in fixed positions opposing each other, thereby forming a recess 20M therebetween. The cushion pad 30 is between the dies 20, and can move vertically within the recess 20M. The cushion pad 30 is supported by a movable cushion rod (not shown). A distance D is defined between each outer side surface of the cushion pad 30 and a corresponding inner surface of each die 20.

Figure 2:
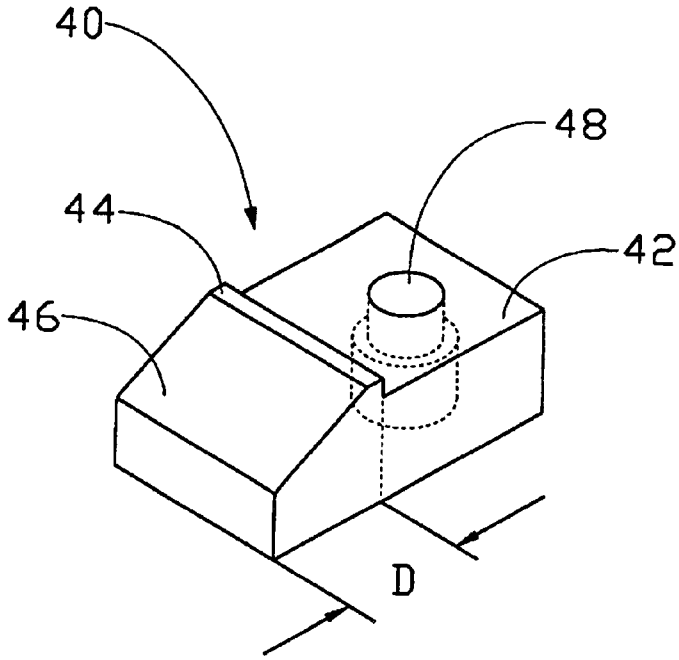
FIG. 2 is a perspective view of a support block shown in the left hand side of FIG. 1.

Referring also to FIG. 2, the support blocks 40 are movable within the recess 20M. Each support block 40 comprises a horizontal portion 42, an inclined portion 46, and a shoulder 44 between the horizontal portion 42 and the inclined portion 46. A screw hole 48 is defined in the horizontal portion 42. The pair of support blocks 40 is secured at respective opposite lateral sides of the cushion pad 30 by bolts (not shown). The bolts (not shown) extend through the screw holes 48 of the support blocks 40 to engage with the cushion pad 30. A vertical face of each shoulder 44 abuts an outer side surface of the cushion pad 30. Thus the distance between the vertical face of the shoulder 44 and a parallel outer side surface of the inclined portion 46 is substantially equal to D.

Figure 3:
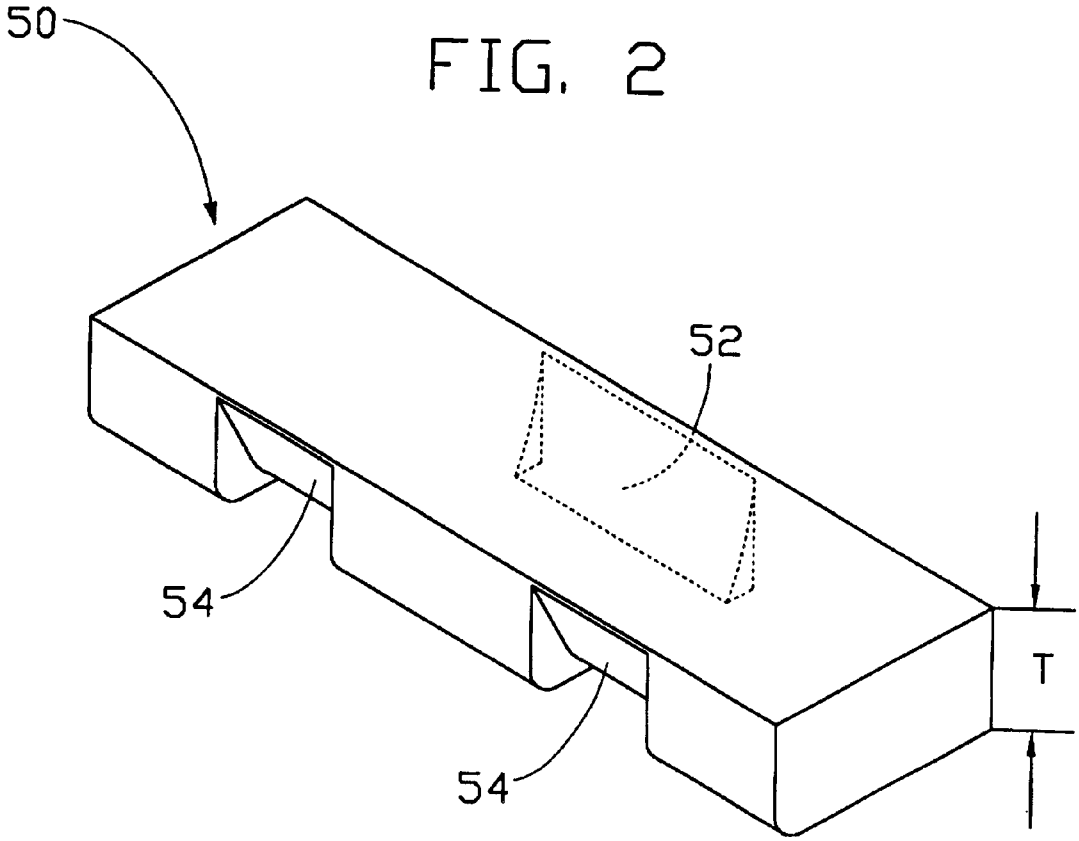
FIG. 3 is a perspective view of a pivoting block shown in the left-hand side of FIG. 1.

Referring also to FIG. 3, the pivoting blocks 50 are mounted on respective top faces 20U of the dies 20. A thickness T of each pivoting block 50 is substantially equal to distance D. A pair of cutouts 54 is defined inan outer face of each pivoting block 50, to prevent the pivoting block 50 from interfering with a fastener (not shown) located outside of the pivoting block 50. A triangular groove 52 is defined in an inner face of each pivoting block 50, to shift the center of gravity of the pivoting block 50 toward the outer face of the pivoting block 50. The functions of the cutouts 54 and the groove 52 are known in the art, so further detailed description thereof is omitted.

Figure 4:
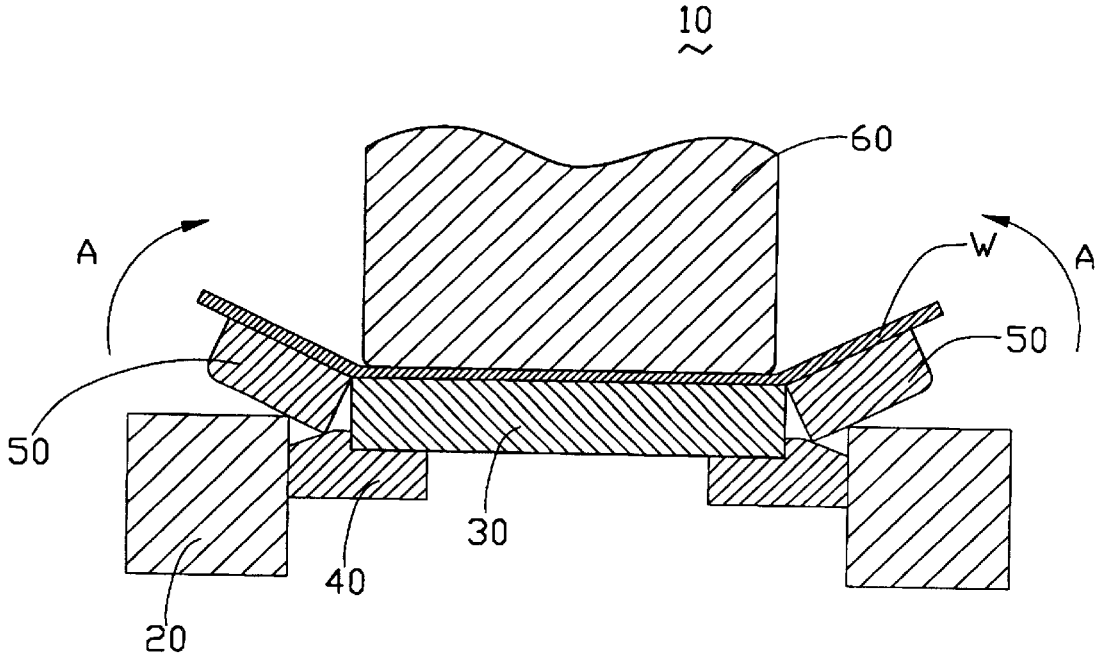
FIG. 4 is a partial cross-sectional view of the folding apparatus, showing an intermediate stage of a folding process of the plate.
Figure 5:
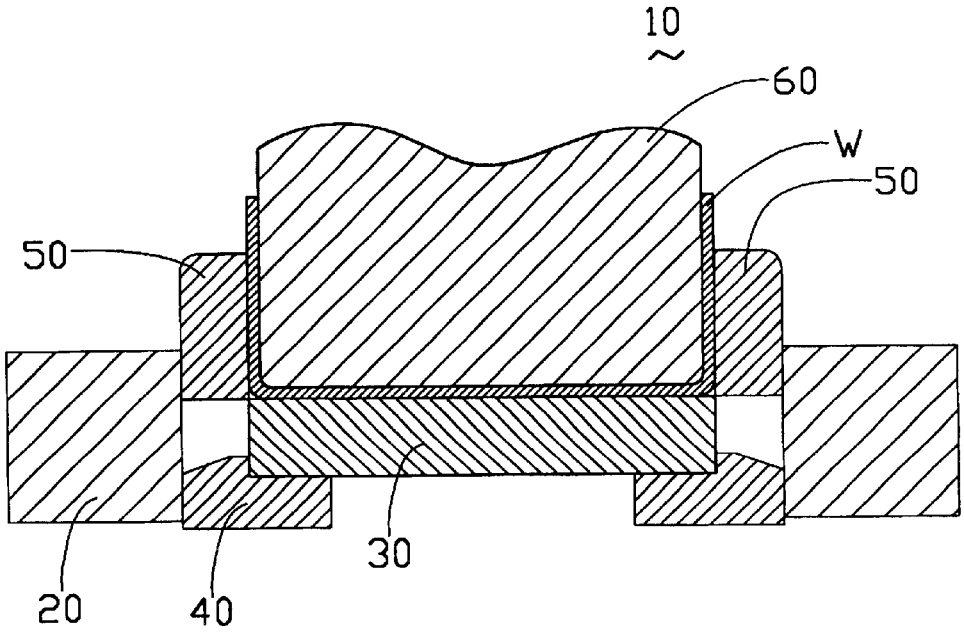
FIG. 5 is a partial cross-sectional view of the folding apparatus, showing the plate bent to a final shape.

Referring to FIGS. 1, 4 and 5, in operation top surfaces of the cushion pad 30 and the pivoting blocks 50 are coplanar. A plate W is placed on the cushion pad 30 and pivoting blocks 50. A central portion of the plate W is held between the cushion pad 30 and a bottom surface of the punch 60. The punch 60 is moved downwardly. This forces the central portion of the plate W to move downwardly, and opposite side portions of the plate W to bend toward the punch 60. Each pivoting block 50 is rotated in direction A (see FIG. 4) about the top inner comer of its adjacent die 20 by friction between the plate W and the pivoting block 50. Thus the plate W is bent at bottom comer edges of the punch 60. The punch 60 continues to move downwardly, and the pivoting blocks 50 eventually complete 90 degree rotations and slide into the recess 20M. The pair of pivoting blocks 50 together with the cushion pad 30 roughly form a U shape. Opposite side portions of the plate W are pressed between the punch 60 and the respective pivoting blocks 20, so that the plate W is folded into its final shape (see FIG. 5).

Figure 6:
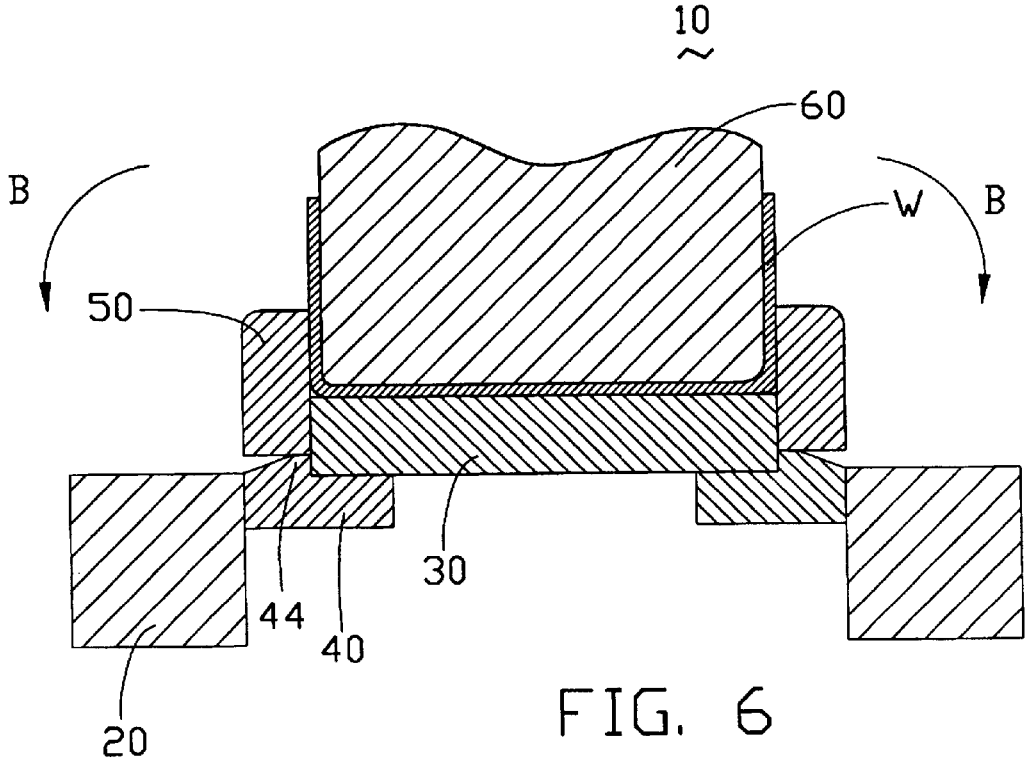
FIG. 6 is a partial cross-sectional view of the folding apparatus, showing a process for removing the plate from the folding apparatus after it has been bent.

Referring to FIG. 6, the punch 60 and the cushion pad 30 are then respectively moved upwardly in cooperation. The shoulders 44 of the support blocks 40 thereby push the pivoting blocks 50 upwardly. When the pivoting blocks 50 exit the recess 20M, they pivotally overbalance at the shoulders 44 of the support blocks 40. The pivoting blocks 50 thus rotate in directions B to return to their original positions. The plate W is then easily removed from the punch 60 by an unload pusher (not shown).

Figure 7:
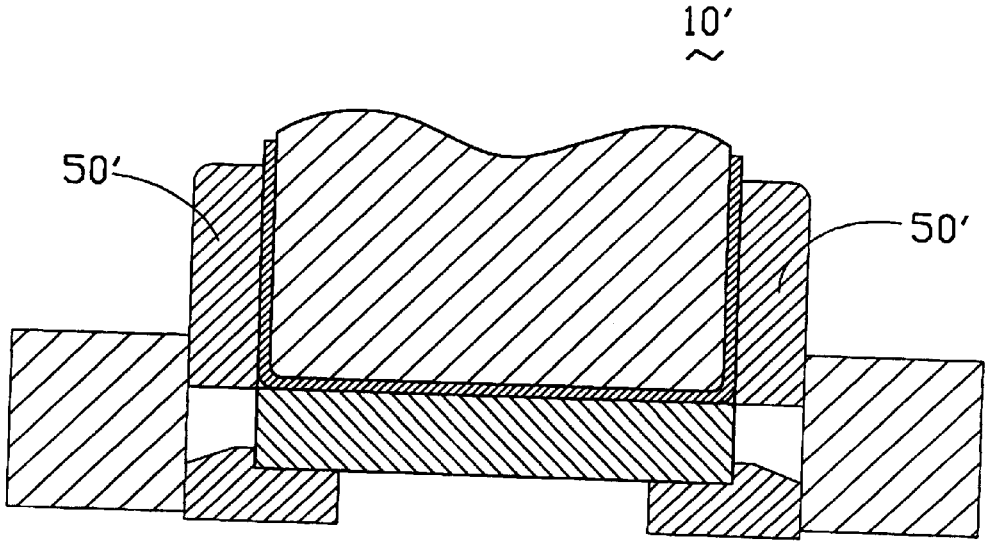
FIG. 7 is a partial cross-sectional view of a folding apparatus in accordance with an alternative embodiment of the present invention.

FIG. 7 shows a folding apparatus 10' in accordance with an alternative embodiment of the present invention. The folding apparatus 10' is substantially similar to the folding apparatus 10. However, the pivoting block 50' is higher than the pivoting block 50, to enable the folding apparatus 10' to form a U-shaped plate with a pair of high walls. Because of the unique configuration of the folding apparatus 10', walls having no distorted concave portions can be formed to heights exceeding the heights of such walls formed by prior art folding apparatus.

Figure 8:
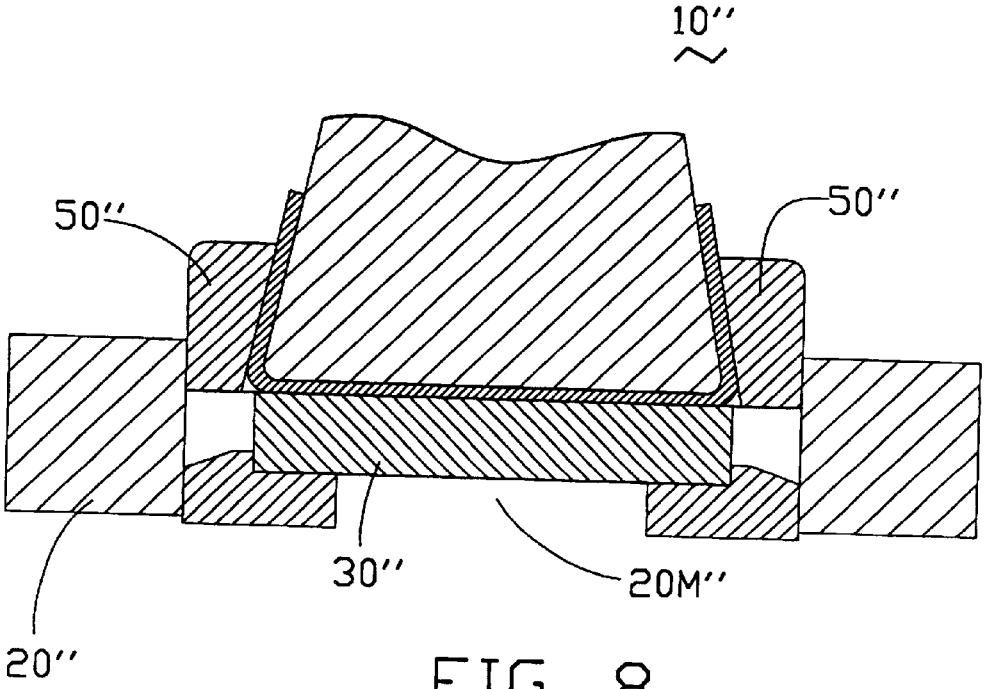
FIG. 8 is a partial cross-sectional view of the folding apparatus in accordance with a further alternative embodiment of the present invention.
Figure 9:
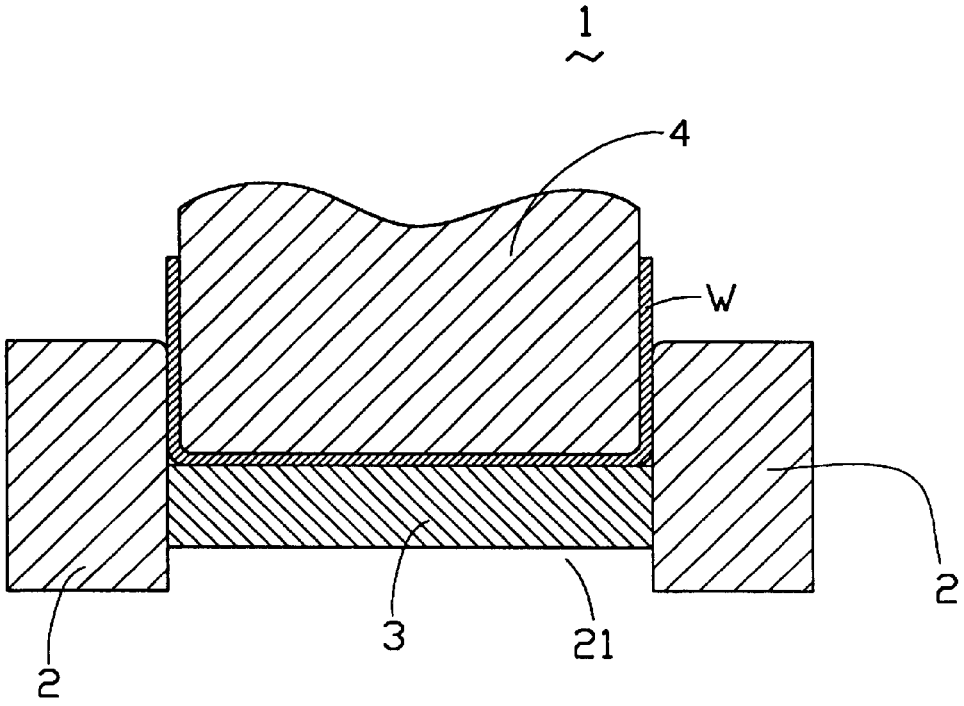
FIG. 9 (PRIOR ART)
FIG. 9 is a partial cross-sectional view of a conventional folding apparatus.

FIG. 8 shows a folding apparatus 10" in accordance with a further alternative embodiment of the present invention. The folding apparatus 10" is substantially similar to the folding apparatus 10, except that the surface of each pivoting block 50" which contacts the plate W is an inclined plane. When each pivoting block 50" slides into the recess 20M", the angle formed between the said surface of the pivoting block 50" and a top surface of the cushion pad 30" is an acute angle. Thus U-shaped plates with a variety of predetermined acute angles can be manufactured, by changing the obliqueness of the said surfaces of the pivoting blocks 50".

It is understood that the invention may be embodied in other forms without departing from the spirit thereof. Thus, the present examples and embodiments are to be considered in all respects as illustrative and not restrictive, and the invention is not to be limited to the details given herein.

I claim:

1. A folding apparatus comprising:

a pair of dies defining a recess therebetween;

a cushion pad vertically movable in the recess;

at least one support block attached to the cushion pad;

at least one pivoting block rotatable about its adjacent die and slidable into the recess, the thickness of the at least one pivoting block being substantially equal to a distance between the cushion pad and the adjacent die; and a vertically movable punch adapted to provide downward movement.

2. The folding apparatus as claimed in claim 1, wherein each support block comprises an inclined portion for allowing rotation of an adjacent pivoting block in the folding process.

3. The folding apparatus as claimed in claim 2, wherein each support block further comprises a horizontal portion for securing to the cushion pad, and a shoulder between the horizontal portion and the inclined portion for facilitating contact between the support block and the adjacent pivoting block in the folding process.

4. The folding apparatus as claimed in claim 3, wherein the horizontal portion of each support block defines a screw hole for extension of a bolt therethrough, thereby securing the support block to the cushion pad.

5. The folding apparatus as claimed in claim 1, wherein each pivoting block defines a groove in an inner surface thereof, for shifting the center of gravity toward an outer portion of the pivoting block.

6. The folding apparatus as claimed in claim 1, wherein the height of each pivoting block is variable such that U-shaped plates with high side walls having no distorted concave portions can be easily and reliably manufactured.

7. The folding apparatus as claimed in claim 1, wherein a surface of each pivoting block which contacts the plate W is an inclined plane such that plates with a variety of predetermined angles can be manufactured by changing the obliqueness of the said surface of each pivoting block.

8. A folding apparatus for use with a bendable plate, comprising:

a pair of dies defining a recess therebetween;

a punch vertically movable in the recess;

a cushion pad vertically movable in the recess opposite to said punch;

at least one support block supporting the pad to resist impact from the punch; and at least one pivoting blockrotatable about adjacent one of said pair of dies wherein said pivoting block is rotated inwardly toward the recess when the punch moves toward the cushion pad, while is rotated outwardly away from the recess when the supporting block moves toward the punch.

9. The folding apparatus as claimed in claim 8, wherein said dies are immoveable.

10. The folding apparatus as claimed in claim 8, wherein the pivoting block is dimensioned with a thickness so that a sum of said thickness of the pivoting block and a thickness of the plate is equal to a horizontal distance between the punch and said adjacent one of said pair of dies.

11. The folding apparatus as claimed in claim 8, wherein said pivoting block is adapted to be vertically moveable in said recess.

12. A method of bending a plate, comprising the steps of:

providing a pair of dies defining a recess therebewteen;

providing a cushion pad vertically moveable in said recess;

providing a supporting block under the cushion pad;

positioning a plate on the cushion pad with one end of said plate extending beyond one end of said cushion;

positioning a punch above the plate;

providing a pivoting block around said end of the plate;

bending said end of the plate by vertically moving the punch toward the cushion and inwardly rotating the pivoting block wherein one side of the pivoting block abutting against the end of the plate and the other side of the pivoting block abutting against adjacent one of said pair of dies; and releasing said bent plate by vertically moving the supporting block toward the punch with the cushion pad generally above the pair of dies, and outwardly rotating the pivoting block away from the recess.

* * * * *